US009663206B2

(12) United States Patent
Lee

(10) Patent No.: US 9,663,206 B2
(45) Date of Patent: May 30, 2017

(54) PADDLE HANDLE

(71) Applicant: James Lee, Aliso Viejo, CA (US)

(72) Inventor: James Lee, Aliso Viejo, CA (US)

( * ) Notice: Subject to any disclaimer, the term of this patent is extended or adjusted under 35 U.S.C. 154(b) by 504 days.

(21) Appl. No.: 14/494,840

(22) Filed: Sep. 24, 2014

(65) Prior Publication Data

US 2015/0098822 A1 Apr. 9, 2015

Related U.S. Application Data

(60) Provisional application No. 61/886,224, filed on Oct. 3, 2013.

(51) Int. Cl.
*B63H 16/04* (2006.01)
*B25G 3/38* (2006.01)
*B25G 3/02* (2006.01)

(52) U.S. Cl.
CPC ..... *B63H 16/04* (2013.01); *B25G 3/02* (2013.01); *B25G 3/38* (2013.01); *Y10T 16/44* (2015.01); *Y10T 16/4713* (2015.01)

(58) Field of Classification Search
CPC ..... B63H 16/04; B25G 3/02; B25G 3/38
USPC ..... 440/101; 416/59, 74
See application file for complete search history.

(56) References Cited

U.S. PATENT DOCUMENTS 4,701,142 A * 10/1987 Merritt ..... B63H 16/04 440/101
8,894,456 B2 * 11/2014 Bicknell ..... B63H 16/04 440/101

* cited by examiner

*Primary Examiner* — Lars A Olson
(74) *Attorney, Agent, or Firm* — Clement Cheng

(57) ABSTRACT

A paddle handle has a handle having a handle outside member connected to a handle inside member by a handle lateral member. A handle attachment member is connected to the handle at the handle inside member. A swivel is connected to the handle attachment member. The swivel has a first position and a second position. A first handle swivel detent and a second handle swivel detent are selectively engaged by a handle swivel engagement member. The first handle swivel detent is at a different angle than the second handle swivel detent. A handle swivel control is connected to the handle swivel engagement member. The handle swivel control is biased to engage into either the first handle swivel detent or the second handle swivel detent.

7 Claims, 5 Drawing Sheets

PADDLE HANDLE

This application is a non-provisional utility patent application of provisional application entitled Paddle Handle application No. 61/886,224 filed Oct. 3, 2013 by inventor James Lee and Samuel Kwok, the disclosure of which is incorporated herein by reference.

FIELD OF THE INVENTION

The present invention is in the field of paddle handles.

DISCUSSION OF RELATED ART

Traditionally, a long shaft paddle has been used for standup paddle boarding. The long shaft paddle provides an extended length for engaging the water from a standing position on a paddle board. Paddle handles have been implemented on kayak paddles for improving grip. Examples of paddle handles include U.S. Pat. No. 8,317,558 to Bucknell entitled Compound Rotational Grip issued Nov. 27, 2012, the disclosure of which is incorporated herein by reference. Hoffman in U.S. Pat. No. 5,695,231 issued Dec. 9, 1997 entitled Leverage Enhancing Grip Assembly, provides a ellipsoid handle grip for a shovel, the disclosure of which is incorporated herein by reference. Hull in U.S. Pat. No. 5,265,307 entitled Ergonomic Adjustable Handle, issued Nov. 30, 1993 provides an attachable handle the disclosure of which is incorporated herein by reference. Merritt in U.S. Pat. No. 4,701,142 entitled Paddle Handle Accessory issued Oct. 20, 1987 provides an attachable handle for a boat paddle, the disclosure of which is incorporated herein by reference.

SUMMARY OF THE INVENTION

A paddle handle has a handle having a handle outside member connected to a handle inside member by a handle lateral member. A handle attachment member is connected to the handle at the handle inside member. A swivel is connected to the handle attachment member. The swivel has a first position and a second position. A first handle swivel detent and a second handle swivel detent are selectively engaged by a handle swivel engagement member. The first handle swivel detent is at a different angle than the second handle swivel detent. A handle swivel control is connected to the handle swivel engagement member. The handle swivel control is biased to engage into either the first handle swivel detent or the second handle swivel detent.

Optionally, a handle opening can be formed on the paddle handle. The paddle handle may also have an attachment base upon which the swivel is mounted. The attachment base has a handle swivel slot. The handle swivel slot allows the handle swivel control to slide along the handle swivel slot. An attachment adapter connects to the swivel. The attachment adapter includes a pair of ring connectors with a pair of ring connector openings for securing to a paddle shaft.

The paddle handle optionally also includes a paddle having a blade formed on the bottom section of the paddle and a paddle shaft formed on the paddle. The attachment adapter is connected to the paddle shaft at the pair of ring connectors. An attachment adapter swivel allows the pair of ring connectors to swivel from a folded position to a deployed position. The pair of ring connectors is parallel to the paddle shaft in the deployed position. The first handle swivel detent and the second handle swivel detent are at 90° from each other to allow and at least 90° rotation of the handle relative to the swivel.

Figure 1:
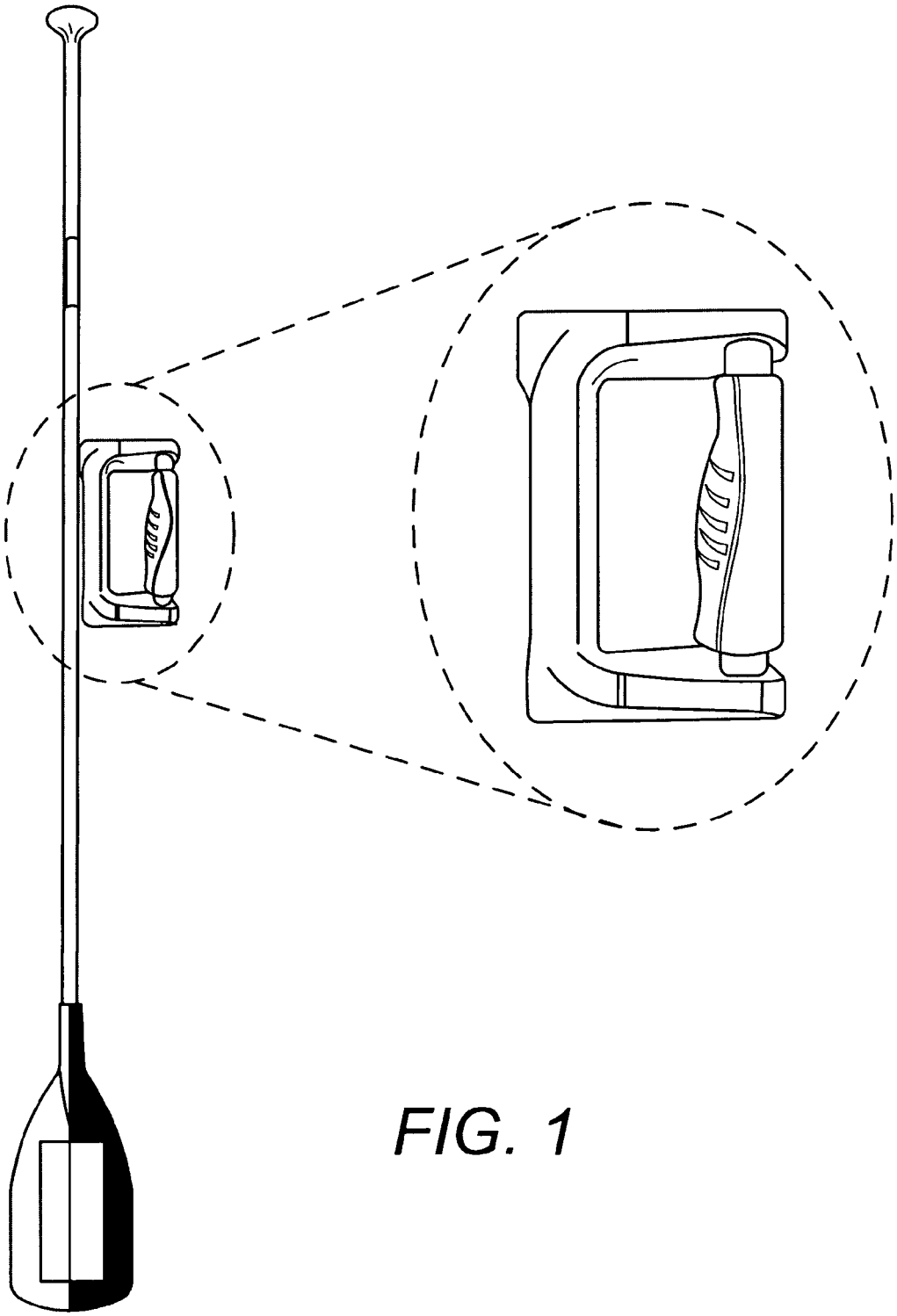
FIG. 1 is a diagram of the paddle handle mounted to a paddle.
Figure 2:
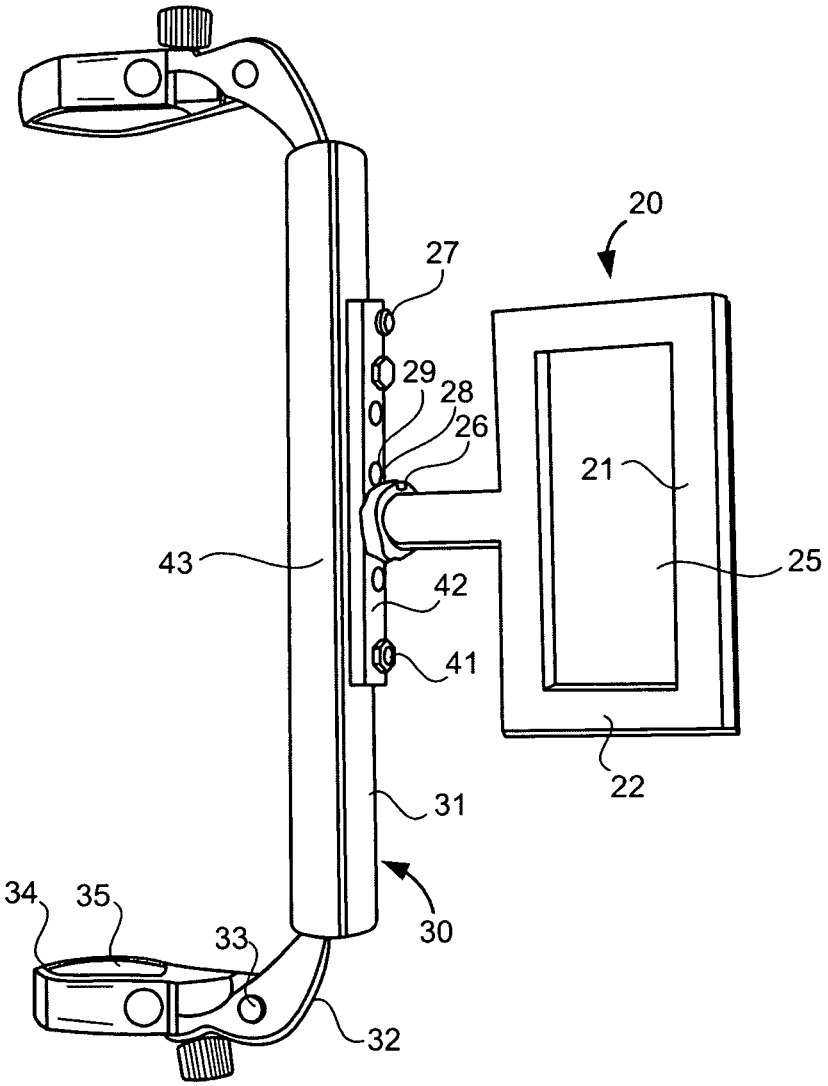
FIG. 2 is a perspective view of the paddle handle.
Figure 3:
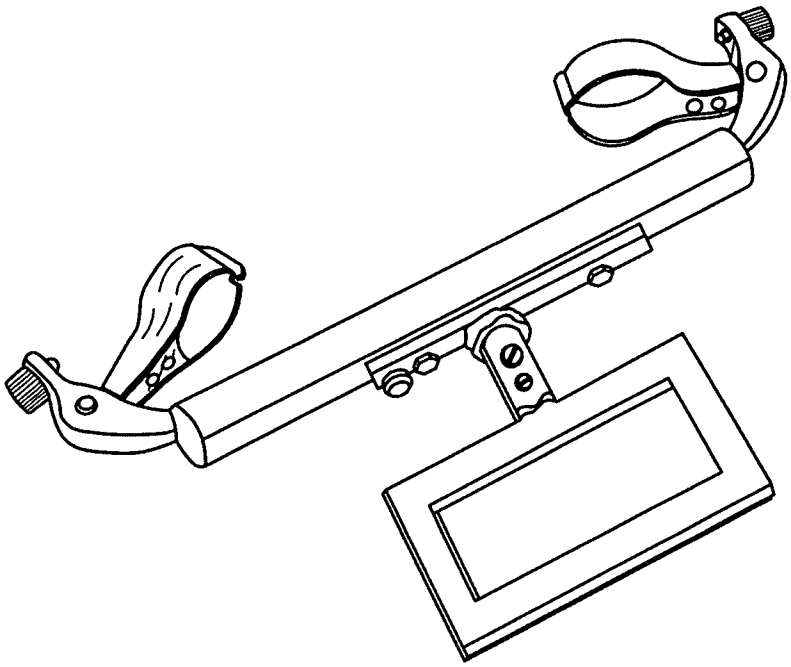
FIG. 3 is a perspective view of the paddle handle.
Figure 4:
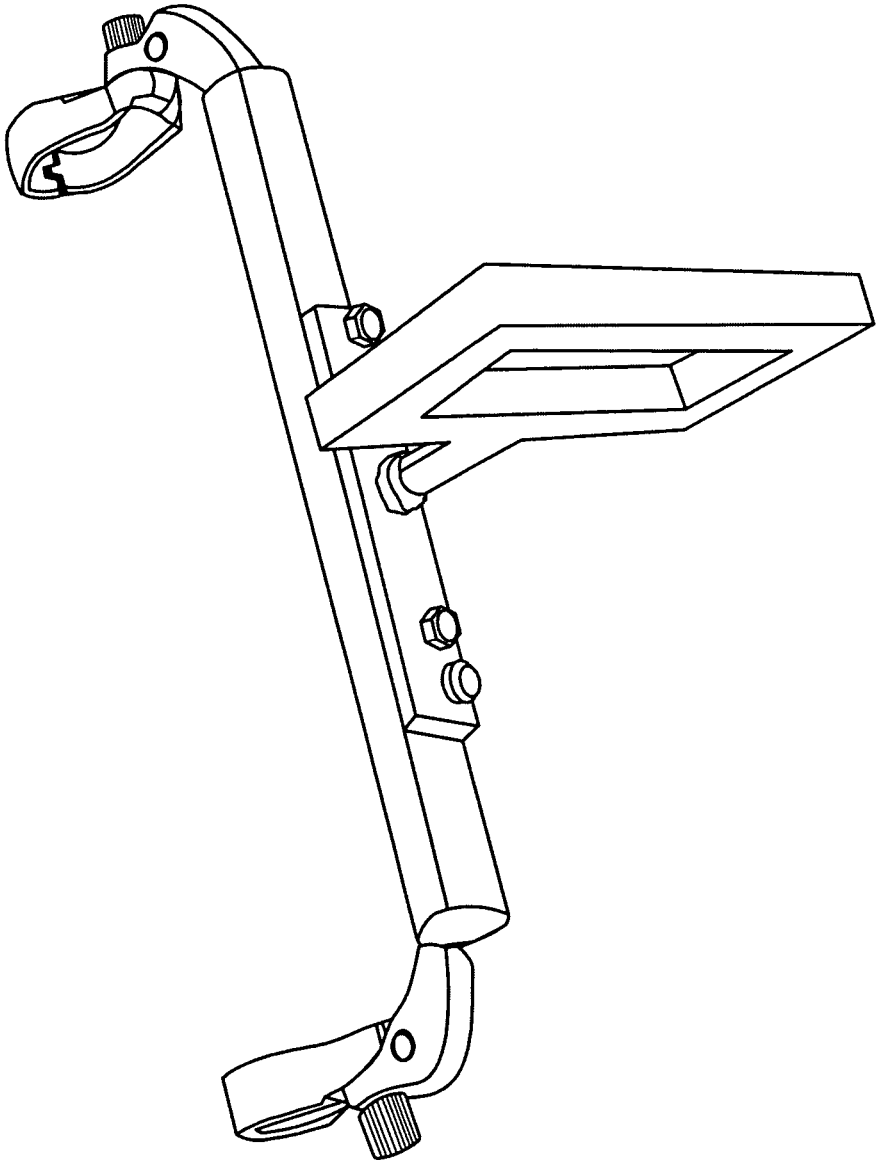
FIG. 4 is a perspective view of the paddle handle.
Figure 5:
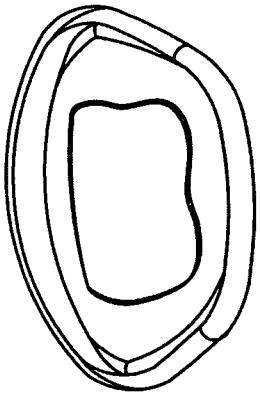
FIG. 5 is a diagram of a possible handle shape.
Figure 6:
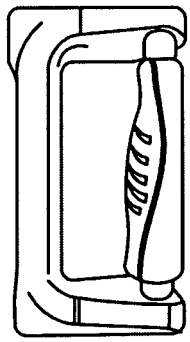
FIG. 6 is a diagram of a possible handle shape.
Figure 7:
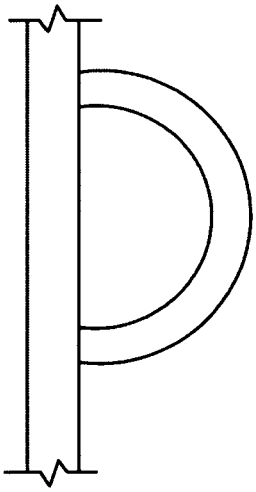
FIG. 7 is a diagram of a possible handle shape.
Figure 8:
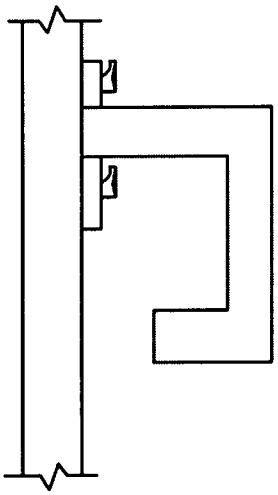
FIG. 8 is a diagram of a possible handle shape.

The following call out list of elements can be a useful guide in referencing the elements of the drawings.

20 Handle
21 Handle Outside Member
22 Handle Lateral Member
23 Handle Inside Member
24 Handle Attachment Member
25 Handle Opening
26 First Handle Swivel Detent
27 Handle Swivel Control
28 Handle Swivel Engagement Member
29 Handle Swivel Slot
30 Attachment Adapter
31 Attachment Adapter Vertical Member
32 Attachment Adapter Bracket
33 Attachment Adapter Swivel
34 Ring Connector
35 Ring Connector Opening
41 Attachment Connector
42 Attachment Base
43 Second Handle Swivel Detent

DETAILED DESCRIPTION OF THE PREFERRED EMBODIMENT

The present invention handle 20 has a handle outside member 21 that is vertical in a vertical position and can be rotated to a horizontal orientation in a horizontal position. The vertical position is defined as parallel to the paddle and the horizontal position is defined as being perpendicular to the paddle. The handle 20 can be rotated between a vertical and horizontal position. The handle outside member 21 is connected to an upper and lower handle lateral member 22. The handle lateral members 22 are connected to the handle inside member 23 so as to form a rectangular loop with a handle opening 25 bounded by the rectangular loop. The handle attachment member 24 connects to the handle inside member 23 at a handle attachment member outside end and the handle attachment member 24 connects to a swivel base at a handle attachment member inside end.

The swivel base has a first handle swivel detent 26 and a second handle swivel detent 43. The first handle swivel detent 26 engages with the handle swivel engagement member 28 when the handle 20 is in vertical position. When the swivel base is rotated 90° to a horizontal position, the first handle swivel detent 26 disengages with the handle swivel engagement member 28. The first handle swivel detent 26 then faces a perpendicular angle relative to the paddle. The second handle swivel detent 43 engages with the handle swivel engagement member 28 when the handle 20 is in a horizontal position.

The handle swivel slot 29 retains the handle swivel engagement member 28 in a sliding relationship with the attachment base 42. The handle swivel slot 29 can be formed as a longitudinal slot extending from the handle swivel control 27 to the handle swivel engagement member 28. The handle swivel control 27 can be formed as a spring biased button to allow engagement and disengagement of the handle swivel engagement member 28 from the first handle swivel detent 26 and from the second handle swivel detent 43. The handle swivel engagement member 28 is connected to the handle swivel control 27 so that the handle swivel engagement member 28 and the handle swivel control 27 can translate along the handle swivel slot 29.

The swivel is mounted to the attachment base 42. The attachment base 42 can be mounted to an attachment adapter 30. The attachment adapter 30 can have an attachment adapter vertical member 31 connected to the attachment base 42 by attachment connectors 41 such as screws or bolts. The attachment adapter 30 is generally aligned parallel to the attachment base 42. The second handle swivel detent 43 provides a second position for the handle swivel that is horizontal and perpendicular to the attachment adapter vertical member 31. The handle adapter vertical member 31 can attach to an attachment adapter bracket 32. The attachment adapter bracket 32 can receive an attachment adapter swivel 33 so that the attachment adapter bracket 32 is in a swivel connection with a ring connector 34. The ring connector 34 has a ring connector opening 35 that is expandable using a bolt to allow connection to a paddle shaft. The paddle shaft can fit into the ring connector 34 because the ring connector opens at a ring connector hinge. The attachment adapter swivel 33 allows the ring connector 34 to fold into a folded position.

Instead of the attachment adapter 30 being connected to the paddle shaft, the attachment adapter 30 can be omitted. When the attachment adapter 30 is omitted, the attachment base 42 is connected directly to the paddle shaft. One of the handle lateral members 22 can be omitted so that the handle opening 25 is located between the handle inside member 23 and the handle outside member 21.

The handle 20 can be mounted to the paddle as a primary grip along with other configurations of handles which can function as secondary grips. A variety of different handles can be shown as being connectable to a typical stand up paddle board paddle. The top section, the middle section and the bottom section are telescopically engaged with each other so that the total length can be changed. The paddle has a top of length adjustment for adjusting a top length of the top section. The paddle has a middle section. The paddle has a lower section that has a lower length adjustment. The user can adjust the top to telescopically extend from the middle section and the user has the option to extend both the top section and lower section to increase the overall length of the paddle. A variety of different handles can be attached to the paddle. A handle can have a swivel base as shown. The swivel base can be a circular swivel base for example. The handle could also have a vertical member that acts as a clip for clipping to a circular section of the middle section of the paddle. The handle could be a pistol grip configuration that has a pivot for pivoting along with a connection. The pivoting connection provides a variety of different angles.

The pivoting connection can have a 90° angle to the shaft, and the pivoting connection can have a 180° angle to the shaft so that it is parallel to the shaft.

The top length adjustment portion of the paddle can have lines to show the graduation of the length of the top section. The lines can correspond to suggested adjustment according to the height of a user. The handle can also be a molded handle. The molded handle may have a pair of screw connections to the shaft. The handle could be made in four vertical members that are spaced and 90° from each other. The handle can also be made in two vertical members that are spaced 180° from each other. The handle could be ornately decorated and formed as a ceramic handle with a pair of bolted connections. The pair of bolted connections may have a base flange to provide greater stability. The base flange may be cylindrical shaped.

The handle can be made integrally formed to the shaft, can be detachable from the shaft and can be made as a bolt on or hook and loop tape strapped connection to the shaft. The grip style can change or be interchangeable. The grip style can be a simple or stylized. The handle can have a smooth cylindrical grip. The handle has a vertical section and a pair of horizontal sections. The horizontal sections can be cylindrical or square cross-section. The vertical section can be cylindrical or square cross-section. The grip style can have an ergonomic grip. The grip style could have a curved arcuate grip. The grip style can have only a horizontal and downward vertical section. The grip style can have a horizontal, then downward vertical section, then horizontal section that does not connect to the shaft. The grip style can have a circular shape. As can be seen from the detailed description and from the drawings, a wide variety of different handle connections can be made to the paddle. The handle connections can be connected using hook or loop tape or by screws connected to a flange extended from the handle. The handle can also be connected by rachet clasps and/or adjustable clasps.

The invention claimed is:

1. A paddle handle comprising:

a. a handle having a handle outside member connected to a handle inside member by a handle lateral member;

b. a handle attachment member connected to the handle at the handle inside member;

c. a swivel connected to the handle attachment member, wherein the swivel has a first position and a second position;

d. a first handle swivel detent and a second handle swivel detent, wherein the first handle swivel detent and the second handle swivel detent are selectively engaged by a handle swivel engagement member, wherein the first handle swivel detent is at a different angle than the second handle swivel detent;

e. a handle swivel control connected to the handle swivel engagement member, wherein the handle swivel control is biased to engage into either the first handle swivel detent or the second handle swivel detent.

2. The paddle handle of claim 1, further comprising: a handle opening.

3. The paddle handle of claim 2, further comprising: an attachment base upon which the swivel is mounted, wherein the attachment base has a handle swivel slot, wherein the handle swivel slot allows the handle swivel control to slide along the handle swivel slot.

4. The paddle handle of claim 3, further comprising: an attachment adapter connecting to the swivel, wherein the attachment adapter includes a pair of ring connectors with a pair of ring connector openings for securing to a paddle shaft.

5. The paddle handle of claim 4, further comprising:

a. a paddle;

b. a blade formed on the bottom section of the paddle; and c. a paddle shaft formed on the paddle, wherein the attachment adapter is connected to the paddle shaft at the pair of ring connectors.

6. The paddle handle of claim 5, further comprising: an attachment adapter swivel, wherein the attachment adapter swivel allows the pair of ring connectors to swivel from a folded position to a deployed position, wherein the pair of ring connectors is parallel to the paddle shaft in the deployed position.

7. The paddle handle of claim 6, wherein the first handle swivel detent and the second handle swivel detent are at 90° from each other to allow and at least 90° rotation of the handle relative to the swivel.

* * * * *